US007905731B2

(12) United States Patent
Ngo et al.

(10) Patent No.: US 7,905,731 B2
(45) Date of Patent: Mar. 15, 2011

(54) ELECTRICAL CONNECTOR WITH STRESS-DISTRIBUTION FEATURES

(75) Inventors: Hung Viet Ngo, Harrisburg, PA (US); Timothy W. Houtz, Etters, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/751,351

(22) Filed: May 21, 2007

(65) Prior Publication Data

US 2008/0293267 A1 Nov. 27, 2008

(51) Int. Cl.
*H01R 12/00* (2006.01)

(52) U.S. Cl. ..... 439/75

(58) Field of Classification Search ..... 439/75, 439/79, 65, 63, 699.1, 751, 295
See application file for complete search history.

(56) References Cited

U.S. PATENT DOCUMENTS

| | | | | |
|---|---|---|---|---|
| 318,186 | A | 5/1885 | Hertzog | |
| 741,052 | A | 10/1903 | Mahon | |
| 1,477,527 | A | 12/1923 | Raettig | |
| 2,248,675 | A | 7/1941 | Huppert | |
| 2,430,011 | A | 11/1947 | Gillentine | 173/361 |
| 2,759,163 | A | 8/1956 | Ustin et al. | |
| 2,762,022 | A | 9/1956 | Benander et al. | |
| 2,844,644 | A | 7/1958 | Soule Jr. | |
| 3,011,143 | A | 11/1961 | Dean | |
| 3,178,669 | A | 4/1965 | Roberts | |
| 3,208,030 | A | 9/1965 | Evans et al. | |
| 3,286,220 | A | 11/1966 | Marley et al. | 439/680 |
| 3,411,127 | A | 11/1968 | Adams | |
| 3,420,087 | A | 1/1969 | Hatfield et al. | |
| 3,514,740 | A | 5/1970 | Filson et al. | |
| 3,538,486 | A | 11/1970 | Shlesinger, Jr. | 439/268 |
| 3,634,811 | A | 1/1972 | Teagno et al. | 339/47 |
| 3,669,054 | A | 6/1972 | Desso et al. | 113/119 |
| 3,692,994 | A | 9/1972 | Hirschmann et al. | 240/11.4 |

(Continued)

FOREIGN PATENT DOCUMENTS

DE 1 665 181 4/1974

(Continued)

OTHER PUBLICATIONS

Finan, J.M., "Thermally Conductive Thermoplastics", LNP Engineering Plastics, Inc., Plastics Engineering 2000, www.4spe.org, 4 pages.

(Continued)

*Primary Examiner* — Alexander Gilman
(74) *Attorney, Agent, or Firm* — Woodcock Washburn LLP

(57) ABSTRACT

A connector capable of being mounted onto a substrate is disclosed. Such a connector may include a housing, and a contact mounted within the housing. The contact may include a body, terminal pins extending from a first edge of the body, contact beams extending from a second edge of the body, and a flared portion. The edges of a first contact beam and a second contact beam of the contact beams may be positioned proximate respective adjacent surfaces of the housing. The flared portion may also be positioned proximate a respective adjacent surface of the housing. The relationship between the first contact beam and its respective adjacent surface, the relationship between the second contact beam and its respective adjacent surface, and the relationship between the flared portion and its respective surface may inhibit bowing of the body of the contact when the connector is mounted on the substrate.

27 Claims, 9 Drawing Sheets

U.S. PATENT DOCUMENTS

| | | | | |
|---|---|---|---|---|
| 3,748,633 | A | 7/1973 | Lundergan | 339/217 |
| 3,845,451 | A | 10/1974 | Neidecker | 339/49 |
| 3,871,015 | A | 3/1975 | Lin et al. | 357/67 |
| 3,942,856 | A | 3/1976 | Mindheim et al. | 339/74 |
| 3,972,580 | A | 8/1976 | Pemberton et al. | 339/47 |
| 4,070,088 | A | 1/1978 | Vaden | 339/252 |
| 4,076,362 | A | 2/1978 | Ichimura | 339/75 |
| 4,082,407 | A | 4/1978 | Smorzaniuk et al. | |
| 4,136,919 | A | 1/1979 | Howard et al. | 339/75 |
| 4,159,861 | A | 7/1979 | Anhalt | 339/75 |
| 4,217,024 | A | 8/1980 | Aldridge et al. | 339/275 |
| 4,260,212 | A | 4/1981 | Ritchie et al. | 339/97 |
| 4,288,139 | A | 9/1981 | Cobaugh et al. | 339/74 |
| 4,371,912 | A | 2/1983 | Guzik | 361/417 |
| 4,383,724 | A | 5/1983 | Verhoeven | 439/510 |
| 4,402,563 | A | 9/1983 | Sinclair | 339/75 |
| 4,403,821 | A | 9/1983 | Zimmerman et al. | 339/97 |
| 4,473,113 | A | 9/1984 | Whitfield et al. | |
| 4,505,529 | A | 3/1985 | Barkus | 439/82 |
| 4,533,187 | A | 8/1985 | Kirkman | |
| 4,536,955 | A | 8/1985 | Gudgeon | 29/840 |
| 4,545,610 | A | 10/1985 | Lakritz et al. | 29/589 |
| 4,552,425 | A | 11/1985 | Billman | 339/47 |
| 4,560,222 | A | 12/1985 | Dambach | 339/75 |
| 4,564,259 | A | 1/1986 | Vandame | 339/258 |
| 4,596,433 | A | 6/1986 | Oesterheld et al. | 339/112 |
| 4,685,886 | A | 8/1987 | Denlinger et al. | 439/55 |
| 4,717,360 | A | 1/1988 | Czaja | 439/710 |
| 4,767,344 | A | 8/1988 | Noschese | 439/83 |
| 4,776,803 | A | 10/1988 | Pretchel et al. | 439/59 |
| 4,782,893 | A | 11/1988 | Thomas | |
| 4,790,763 | A | 12/1988 | Weber et al. | |
| 4,815,987 | A | 3/1989 | Kawano et al. | 439/263 |
| 4,818,237 | A | 4/1989 | Weber | |
| 4,820,169 | A | 4/1989 | Weber et al. | |
| 4,820,182 | A | 4/1989 | Harwath et al. | 439/290 |
| 4,867,713 | A | 9/1989 | Ozu et al. | 439/833 |
| 4,878,611 | A | 11/1989 | LoVasco et al. | 228/180.2 |
| 4,881,905 | A | 11/1989 | Demler, Jr. et al. | 439/79 |
| 4,900,271 | A | 2/1990 | Colleran et al. | 439/595 |
| 4,907,990 | A | 3/1990 | Bertho et al. | 439/851 |
| 4,915,641 | A | 4/1990 | Miskin et al. | |
| 4,956,699 | A | 9/1990 | Ohashi | |
| 4,963,102 | A | 10/1990 | Gettig et al. | 439/291 |
| 4,965,699 | A | 10/1990 | Jorden et al. | |
| 4,973,257 | A | 11/1990 | Lhotak | 439/81 |
| 4,973,271 | A | 11/1990 | Ishizuka et al. | 439/839 |
| 4,974,119 | A | 11/1990 | Martin | |
| 4,975,084 | A | 12/1990 | Fedder et al. | |
| 4,979,074 | A | 12/1990 | Morley et al. | |
| 5,016,968 | A | 5/1991 | Hammond et al. | |
| 5,024,610 | A | 6/1991 | French et al. | 439/857 |
| 5,035,639 | A | 7/1991 | Kilpatrick et al. | 439/290 |
| 5,046,960 | A | 9/1991 | Fedder et al. | |
| 5,052,953 | A | 10/1991 | Weber | 439/857 |
| 5,066,236 | A | 11/1991 | Broeksteeg | 439/79 |
| 5,077,893 | A | 1/1992 | Mosquera et al. | 29/882 |
| 5,082,459 | A | 1/1992 | Billman et al. | 439/637 |
| 5,094,634 | A | 3/1992 | Dixon et al. | 431/751 |
| 5,104,332 | A | 4/1992 | McCoy | 439/290 |
| 5,137,959 | A | 8/1992 | Block et al. | |
| 5,139,426 | A | 8/1992 | Barkus et al. | |
| 5,151,056 | A | 9/1992 | McClune | |
| 5,152,700 | A | 10/1992 | Bogursky et al. | |
| 5,174,770 | A | 12/1992 | Sasaki et al. | 439/108 |
| 5,194,480 | A | 3/1993 | Block et al. | |
| 5,213,868 | A | 5/1993 | Liberty et al. | |
| 5,214,308 | A | 5/1993 | Nishiguchi et al. | 257/692 |
| 5,238,414 | A | 8/1993 | Yaegashi et al. | 439/108 |
| 5,254,012 | A | 10/1993 | Wang | 439/263 |
| 5,274,918 | A | 1/1994 | Reed | 29/882 |
| 5,276,964 | A | 1/1994 | Anderson, Jr. et al. | |
| 5,286,212 | A | 2/1994 | Broeksteeg | |
| 5,295,843 | A | 3/1994 | Davis et al. | |
| 5,298,791 | A | 3/1994 | Liberty et al. | |
| 5,302,135 | A | 4/1994 | Lee | 439/263 |
| 5,321,582 | A | 6/1994 | Casperson | |
| 5,381,314 | A | 1/1995 | Rudy, Jr. et al. | 361/712 |
| 5,400,949 | A | 3/1995 | Hirvonen et al. | 228/180.22 |
| 5,427,543 | A | 6/1995 | Dynia | 439/346 |
| 5,431,578 | A | 7/1995 | Wayne | 439/259 |
| 5,457,342 | A | 10/1995 | Herbst, II | 257/712 |
| 5,458,426 | A | 10/1995 | Ito | |
| 5,475,922 | A | 12/1995 | Tamura et al. | 29/881 |
| 5,490,040 | A | 2/1996 | Gavdenzi et al. | 361/773 |
| 5,511,987 | A | 4/1996 | Shinchi | |
| 5,512,519 | A | 4/1996 | Hwang | |
| 5,533,915 | A | 7/1996 | Deans | 439/678 |
| 5,558,542 | A | 9/1996 | O'Sullivan et al. | 439/682 |
| 5,564,952 | A | 10/1996 | Davis et al. | |
| 5,577,928 | A | 11/1996 | Duclos | 439/290 |
| 5,582,519 | A | 12/1996 | Buchter | |
| 5,588,859 | A | 12/1996 | Maurice | 439/290 |
| 5,590,463 | A | 1/1997 | Feldman et al. | 29/844 |
| 5,609,502 | A | 3/1997 | Thumma | 439/747 |
| 5,618,187 | A | 4/1997 | Goto | 439/79 |
| 5,637,008 | A | 6/1997 | Kozel | 439/342 |
| 5,643,009 | A | 7/1997 | Dinkel et al. | |
| 5,664,968 | A | 9/1997 | Micklevicz | |
| 5,664,973 | A | 9/1997 | Emmert et al. | 439/862 |
| 5,667,392 | A | 9/1997 | Kocher et al. | |
| 5,691,041 | A | 11/1997 | Frankeny et al. | 428/209 |
| 5,702,255 | A | 12/1997 | Murphy et al. | 439/71 |
| 5,727,963 | A | 3/1998 | LeMaster | |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,742,484 | A | 4/1998 | Gillette et al. | 361/789 |
| 5,743,009 | A | 4/1998 | Matsui et al. | 29/843 |
| 5,745,349 | A | 4/1998 | Lemke | 361/818 |
| 5,746,608 | A | 5/1998 | Taylor | 439/70 |
| 5,749,746 | A | 5/1998 | Tan et al. | |
| 5,755,595 | A | 5/1998 | Davis et al. | 439/607 |
| 5,772,451 | A | 6/1998 | Dozier, II et al. | 439/70 |
| 5,782,644 | A | 7/1998 | Kiat | |
| 5,787,971 | A | 8/1998 | Dodson | 165/121 |
| 5,795,191 | A | 8/1998 | Preputnick et al. | 439/608 |
| 5,810,607 | A | 9/1998 | Shih et al. | 439/66 |
| 5,817,973 | A | 10/1998 | Elco et al. | 174/32 |
| 5,827,094 | A | 10/1998 | Aizawa et al. | |
| 5,831,314 | A | 11/1998 | Wen | 257/391 |
| 5,857,857 | A | 1/1999 | Fukuda | 439/188 |
| 5,874,776 | A | 2/1999 | Kresge et al. | 257/747 |
| 5,876,219 | A | 3/1999 | Taylor et al. | 439/74 |
| 5,876,248 | A | 3/1999 | Brunker et al. | |
| 5,882,214 | A | 3/1999 | Hillbish et al. | |
| 5,883,782 | A | 3/1999 | Thurston et al. | 364/704 |
| 5,888,884 | A | 3/1999 | Wojnarowski | 438/462 |
| 5,908,333 | A | 6/1999 | Perino et al. | 439/631 |
| 5,919,050 | A | 7/1999 | Kehley et al. | 439/71 |
| 5,930,114 | A | 7/1999 | Kuzmin et al. | 361/704 |
| 5,955,888 | A | 9/1999 | Frederickson et al. | 324/761 |
| 5,961,355 | A | 10/1999 | Morlion et al. | 439/686 |
| 5,971,817 | A | 10/1999 | Longueville | 439/857 |
| 5,975,921 | A | 11/1999 | Shuey | 439/83 |
| 5,980,270 | A | 11/1999 | Fjelstad et al. | 439/71 |
| 5,980,321 | A | 11/1999 | Cohen et al. | 439/608 |
| 5,984,726 | A | 11/1999 | Wu | 439/607 |
| 5,993,259 | A | 11/1999 | Stokoe et al. | 439/608 |
| 6,012,948 | A | 1/2000 | Wu | 439/567 |
| 6,036,549 | A | 3/2000 | Wulff | |
| 6,041,498 | A | 3/2000 | Hillbish et al. | |
| 6,050,862 | A | 4/2000 | Ishii | 439/843 |
| 6,059,170 | A | 5/2000 | Jimarez et al. | 228/119 |
| 6,066,048 | A | 5/2000 | Lees | |
| 6,068,520 | A | 5/2000 | Winings et al. | 439/676 |
| 6,071,152 | A | 6/2000 | Achammer et al. | 439/733.1 |
| 6,077,130 | A | 6/2000 | Hughes et al. | 439/862 |
| 6,089,878 | A | 7/2000 | Meng | 439/79 |
| 6,095,827 | A | 8/2000 | Dutkowsky et al. | 439/83 |
| 6,123,554 | A | 9/2000 | Ortega et al. | 439/79 |
| 6,125,535 | A | 10/2000 | Chiou et al. | 29/883 |
| 6,139,336 | A | 10/2000 | Olson | 439/83 |
| 6,146,157 | A | 11/2000 | Lenoir et al. | 439/101 |
| 6,146,202 | A | 11/2000 | Ramey et al. | 439/608 |
| 6,146,203 | A | 11/2000 | Elco et al. | 439/608 |
| 6,152,756 | A | 11/2000 | Huang et al. | 439/342 |

6,174,198 B1 1/2001 Wu et al. ..... 439/541.5
6,180,891 B1 1/2001 Murdeshwar ..... 174/260
6,183,287 B1 2/2001 Po
6,183,301 B1 2/2001 Paagman ..... 439/608
6,190,213 B1 2/2001 Reichart et al. ..... 439/736
6,196,871 B1 3/2001 Szu ..... 439/571
6,202,916 B1 3/2001 Updike et al. ..... 228/180
6,206,722 B1 3/2001 Ko et al.
6,210,197 B1 4/2001 Yu ..... 439/342
6,210,240 B1 * 4/2001 Comerci et al. ..... 439/853
6,212,755 B1 4/2001 Shimada et al. ..... 29/527.1
6,215,180 B1 4/2001 Chen et al. ..... 257/720
6,219,913 B1 4/2001 Uchiyama ..... 29/883
6,220,884 B1 4/2001 Lin ..... 439/342
6,220,895 B1 4/2001 Lin ..... 439/607
6,220,896 B1 4/2001 Bertoncini et al. ..... 439/608
6,234,851 B1 5/2001 Phillips ..... 439/825
6,238,225 B1 5/2001 Middlehurst et al.
6,257,478 B1 7/2001 Straub ..... 228/6.2
6,259,039 B1 7/2001 Chroneos, Jr. et al. ..... 174/263
6,261,132 B1 7/2001 Koseki et al.
6,269,539 B1 8/2001 Takahashi et al. ..... 29/883
6,274,474 B1 8/2001 Caletka et al. ..... 438/613
6,280,230 B1 8/2001 Takase et al.
6,293,827 B1 9/2001 Stokoe et al. ..... 439/608
6,299,492 B1 10/2001 Pierini et al. ..... 439/884
6,309,245 B1 10/2001 Sweeney ..... 439/507
6,319,075 B1 11/2001 Clark et al. ..... 439/825
6,322,377 B2 11/2001 Middlehurst et al.
6,328,602 B1 12/2001 Yamasaki et al. ..... 439/608
6,347,952 B1 2/2002 Hasegawa et al. ..... 439/608
6,350,134 B1 2/2002 Fogg et al. ..... 439/79
6,359,783 B1 3/2002 Noble ..... 361/704
6,360,940 B1 3/2002 Bolde et al. ..... 228/264
6,362,961 B1 3/2002 Chiou ..... 361/704
6,363,607 B1 4/2002 Chen et al. ..... 29/883
6,371,773 B1 4/2002 Crofoot et al. ..... 439/79
6,379,188 B1 4/2002 Cohen et al. ..... 439/608
6,386,924 B2 5/2002 Long
6,394,818 B1 5/2002 Smalley, Jr.
6,402,566 B1 6/2002 Middlehurst et al.
6,409,543 B1 6/2002 Astbury, Jr. et al. ..... 439/608
6,428,328 B2 8/2002 Haba et al. ..... 439/70
6,431,914 B1 8/2002 Billman ..... 439/608
6,435,914 B1 8/2002 Billman ..... 439/608
6,450,829 B1 9/2002 Weisz-Margulescu
6,461,183 B1 10/2002 Ohkita et al.
6,461,202 B2 10/2002 Kline ..... 439/701
6,471,523 B1 10/2002 Shuey ..... 439/63
6,471,548 B2 10/2002 Bertoncini et al. ..... 439/608
6,472,474 B2 10/2002 Burkhardt et al.
6,488,549 B1 12/2002 Weller et al.
6,489,567 B2 12/2002 Zachrai
6,506,081 B2 1/2003 Blanchfield et al. ..... 439/682
6,514,103 B2 2/2003 Pape et al. ..... 439/608
6,537,111 B2 3/2003 Brammer et al. ..... 439/857
6,544,046 B1 4/2003 Hahn et al. ..... 439/83
6,551,112 B1 4/2003 Li et al. ..... 439/66
6,554,647 B1 4/2003 Cohen et al. ..... 439/607
6,572,410 B1 6/2003 Volstorf et al. ..... 439/608
6,575,774 B2 6/2003 Ling et al.
6,575,776 B1 6/2003 Conner et al.
6,592,381 B2 7/2003 Cohen et al. ..... 439/80
6,604,967 B2 8/2003 Middlehurst et al.
6,629,854 B2 10/2003 Murakami
6,652,318 B1 11/2003 Winings et al. ..... 439/608
6,663,426 B2 12/2003 Hasircoglu et al. ..... 439/608
6,665,189 B1 12/2003 Lebo ..... 361/730
6,669,514 B2 12/2003 Weibking et al. ..... 439/701
6,672,884 B1 1/2004 Toh et al.
6,672,907 B2 1/2004 Azuma ..... 439/682
6,692,272 B2 2/2004 Lemke et al. ..... 439/108
6,702,594 B2 3/2004 Lee et al. ..... 439/83
6,705,902 B1 3/2004 Yi et al. ..... 439/678
6,712,621 B2 3/2004 Li et al. ..... 439/65
6,716,068 B2 4/2004 Wu ..... 439/733.1
6,740,820 B2 5/2004 Cheng ..... 174/260
6,743,037 B2 6/2004 Kassa et al. ..... 439/342
6,746,278 B2 6/2004 Nelson et al. ..... 439/608
6,769,883 B2 8/2004 Brid et al.
6,769,935 B2 8/2004 Stokoe et al. ..... 439/608
6,776,635 B2 8/2004 Blanchfield et al. ..... 439/181
6,776,649 B2 8/2004 Pape et al. ..... 439/485
6,780,027 B2 8/2004 Allison
6,790,088 B2 9/2004 Ono et al. ..... 439/607
6,796,831 B1 9/2004 Yasufuku et al. ..... 439/485
6,810,783 B1 11/2004 Larose
6,811,440 B1 11/2004 Rothermel et al. ..... 439/608
6,814,590 B2 11/2004 Minich et al.
6,829,143 B2 12/2004 Russell et al. ..... 361/704
6,835,103 B2 * 12/2004 Middlehurst et al. ..... 439/699.1
6,843,687 B2 1/2005 McGowan et al. ..... 439/608
6,848,886 B2 2/2005 Schmaling et al. ..... 416/134
6,848,950 B2 2/2005 Allison et al. ..... 439/682
6,848,953 B2 2/2005 Schell et al. ..... 439/825
6,869,294 B2 3/2005 Clark et al. ..... 439/79
6,884,117 B2 4/2005 Korsunsky et al. ..... 439/607
6,890,221 B2 5/2005 Wagner ..... 439/855
6,905,367 B2 6/2005 Crane, Jr. et al. ..... 439/608
6,929,504 B2 8/2005 Ling et al. ..... 439/485
6,947,012 B2 9/2005 Aisenbrey ..... 343/906
6,975,511 B1 12/2005 Lebo et al. ..... 361/703
6,994,569 B2 2/2006 Minich et al.
7,001,189 B1 2/2006 McGowan et al. ..... 439/79
7,059,892 B1 6/2006 Trout
7,059,919 B2 6/2006 Clark et al.
7,065,871 B2 6/2006 Minich et al.
7,070,464 B2 7/2006 Clark et al. ..... 439/825
7,074,096 B2 7/2006 Copper et al. ..... 439/843
7,097,465 B1 8/2006 Korsunsky et al.
7,101,228 B2 9/2006 Hammer et al. ..... 439/637
7,104,812 B1 9/2006 Bogiel et al. ..... 439/79
7,114,963 B2 10/2006 Shuey et al. ..... 439/79
RE39,380 E 11/2006 Davis
7,137,848 B1 11/2006 Trout et al.
7,168,963 B2 1/2007 Minich et al. ..... 439/79
7,182,642 B2 2/2007 Ngo et al. ..... 439/608
7,204,699 B2 4/2007 Stoner
D542,736 S 5/2007 Riku ..... D13/147
7,220,141 B2 5/2007 Daily et al.
7,258,562 B2 8/2007 Daily et al.
7,273,382 B2 9/2007 Igarashi et al.
7,303,427 B2 12/2007 Swain
7,335,043 B2 2/2008 Hgo et al.
7,374,461 B2 5/2008 van der Steen
7,384,289 B2 6/2008 Minich
7,425,145 B2 9/2008 Ngo
7,458,839 B2 12/2008 Ngo
7,476,108 B2 1/2009 Swain et al.
2001/0003685 A1 6/2001 Aritani ..... 439/485
2001/0049229 A1 12/2001 Pape et al.
2002/0106930 A1 8/2002 Pape et al. ..... 439/485
2002/0142676 A1 10/2002 Hosaka et al. ..... 439/874
2002/0159235 A1 10/2002 Miller et al. ..... 361/704
2002/0193019 A1 12/2002 Blanchfield et al. ..... 439/857
2003/0013330 A1 1/2003 Takeuchi ..... 439/83
2003/0119378 A1 6/2003 Avery
2003/0143894 A1 7/2003 Kline et al. ..... 439/608
2003/0219999 A1 * 11/2003 Minich et al. ..... 439/79
2003/0220021 A1 11/2003 Whiteman, Jr. et al. ..... 439/608
2003/0236035 A1 12/2003 Kuroda et al. ..... 439/857
2004/0147177 A1 7/2004 Wagner
2004/0183094 A1 9/2004 Caletka et al. ..... 257/178
2005/0112952 A1 5/2005 Wang et al. ..... 439/660
2006/0003620 A1 1/2006 Daily et al. ..... 439/295
2006/0128197 A1 6/2006 McGowan et al.
2006/0228927 A1 10/2006 Daily
2006/0228948 A1 10/2006 Swain
2006/0281354 A1 12/2006 Ngo et al. ..... 439/290
2007/0197063 A1 8/2007 Ngo
2007/0202748 A1 8/2007 Daily
2007/0275586 A1 11/2007 Ngo
2007/0293084 A1 12/2007 Ngo
2008/0038956 A1 2/2008 Swain
2008/0248670 A1 10/2008 Daily et al.

FOREIGN PATENT DOCUMENTS

| | | | |
|---|---|---|---|
| DE | 102 26 279 | C1 | 11/2003 |
| EP | 0 273 683 | A2 | 7/1988 |
| EP | 0 321 257 | B1 | 4/1993 |
| EP | 0 623 248 | B1 | 11/1995 |
| EP | 0 789 422 | A2 | 8/1997 |
| EP | 1091449 | B1 | 9/2004 |
| GB | 1 162 705 | | 8/1969 |
| JP | 05344728 | | 12/1993 |
| JP | 06068943 | | 3/1994 |
| JP | 06-236788 | | 8/1994 |
| JP | 07-114958 | | 5/1995 |
| JP | 07169523 | | 7/1995 |
| JP | 08096918 | | 4/1996 |
| JP | 0 812 5379 | | 5/1996 |
| JP | 09199215 | | 7/1997 |
| JP | 2000-003743 | | 1/2000 |
| JP | 2000-003744 | | 1/2000 |
| JP | 2000-003745 | | 1/2000 |
| JP | 2000-003746 | | 1/2000 |
| JP | 13135388 | | 5/2001 |
| JP | 2003217785 | | 7/2003 |
| KR | 100517561 | B1 | 9/2005 |
| TW | 576555 | | 8/1990 |
| TW | 546872 | | 8/2003 |
| WO | WO 97/43885 | | 11/1997 |
| WO | WO 97/44859 | | 11/1997 |
| WO | WO 98/15989 | | 4/1998 |
| WO | WO 0016445 | | 3/2000 |
| WO | WO 01/29931 | A1 | 4/2001 |
| WO | WO 01/39332 | A1 | 5/2001 |
| WO | WO 02103847 | | 12/2002 |
| WO | WO2005065254 | | 7/2005 |
| WO | WO 2007064632 | | 6/2007 |

OTHER PUBLICATIONS

Sherman, L.M., "Plastics that Conduct Heat", Plastics Technology Online, Jun. 2001, http://www.plasticstechnology.com, 4 pages.

Ogando, J., "And now—An Injection-Molded Heat Exchanger", Sure, plastics are thermal insulators, but additive packages allow them to conduct heat instead, Global Design News, Nov. 1, 2000, 4 pages.

U.S. Appl. No. 12/317,366, filed Dec. 22, 2008, Minich.

Metral 1000 Series, PCB Mounted Receptacle Assembly, FCI Web Site page, 2001, 1 p.

Power TwinBlade™ I/O Cable Connector RA-North-South, No. GS-20_072, Aug. 6, 2007, 11 pages.

Product Datasheets, 10 Bgit/s XENPAK 850 nm Transponder (TRP10GVP2045), Copyright 2005, MergeOptics GmbH, 13 pages.

Product Datasheets, Welome to XENPAK.org., Copyright 2001, http://www.xenpak.org., 1 page.

* cited by examiner

ELECTRICAL CONNECTOR WITH STRESS-DISTRIBUTION FEATURES

CROSS REFERENCE TO RELATED APPLICATIONS

This application is related by subject matter to U.S. patent application Ser. No. 12/054,023 filed Mar. 24, 2008, and is also related by subject matter to U.S. patent application Ser. No. 12/109,750 filed Apr. 25, 2008.

FIELD OF THE INVENTION

Generally the invention relates to electrical connectors. More particularly the invention relates to power connectors.

BACKGROUND OF THE INVENTION

A Power connector for transmitting electrical power may be mounted onto a printed circuit board ("PCB") using a press fit. The press fit application of the connector may generate some concerns about the contact deformation and damage to the housing, especially on a vertical receptacle or header connector. More particularly, if a large enough gap exists between the contact beams of the contacts and the interior walls of the housing, the middle portions of the press-fit tails may arc or bow away from the PCB during mounting of the connector onto the PCB.

For example, FIGS. 1A and 1B depict the relationship between a contact 10 and a housing 14 of a prior art connector. As depicted, the contact 10 has a body 16 and a plurality of contact beams 18 extending from a first edge 20 of the body 16. When the contact 10 is mounted in the housing 14, a large gap 24 exists between an edge 28 of a first contact beam 32 of the plurality of contact beams 18 and an upper sidewall 36 of the housing 14. Further, when the contact 10 is mounted in the housing 14, a large gap 40 exists between an edge 44 of a second contact beam 48 of the plurality of contact beams 18 and a lower sidewall 52 of the housing 14. When the press pins (not shown) of the contact 10 are pressed into a substrate (not shown), the body 16 of the contact 10 may arc or bow. A middle point 56 of the body 16 may displace about 0.246 mm due to the arcing or bowing of the contact 10. FIG. 1C depicts a bowed or arced contact 10. Because the body 16 is bowed, the contact beams 18 spread apart causing different sized gaps 58 between adjacent contact beams 18. Accordingly, a need exists for features that reduce or eliminate such arcing or bowing of the body 16 may be desired.

SUMMARY OF THE INVENTION

Disclosed herein is an electrical connector that may be capable of inhibiting bowing of the contacts of the connector when the connector is mounted on a substrate. Such a connector may include a housing and a contact mounted in the housing. The contact may include a body, a plurality of terminal pins extending from a first edge of the body and a plurality of contact beams extending from a second edge of the body. At least a portion of the edges of a first contact beam and of a second contact beam may be positioned proximate respective adjacent surfaces of the housing when the connector is not mounted on the substrate. Contact between the at least a portion of the edges of the first and second contact beams and their respective adjacent surfaces of the housing during mounting of the connector on the substrate may restrain the contact beams and may inhibit bowing of the body of the contact. The contact beams may be arranged in a substantially linear array and the first and second contact beams may be located at respective first and second ends of the substantially linear array.

In another embodiment of the connector, the body of the contact may include a flared portion. The flared portion may be positioned proximate an adjacent surface of the housing when the connector is not mounted on the substrate. Contact between the flared portion and the surface of the housing adjacent the flared portion during mounting of the connector on the substrate may inhibit bowing of the body of the contact.

DETAILED DESCRIPTION OF ILLUSTRATIVE EMBODIMENTS

Figure 1B:
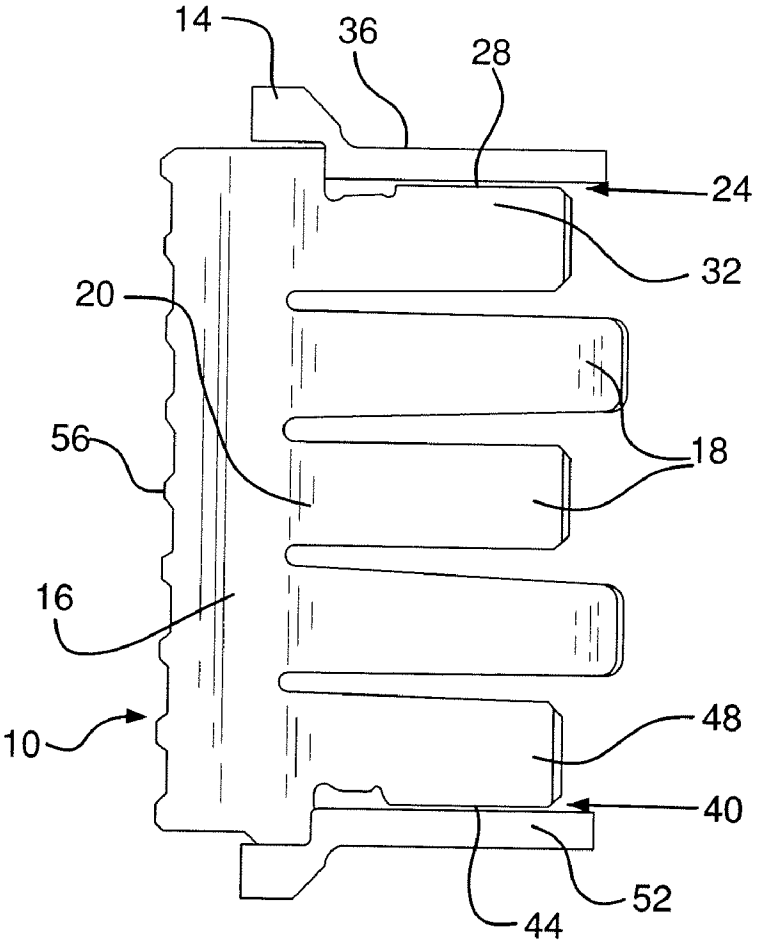
FIG. 1B (Prior Art)
FIG. 1B is a side view of the connector system of FIG. 1A.
Figure 1A:
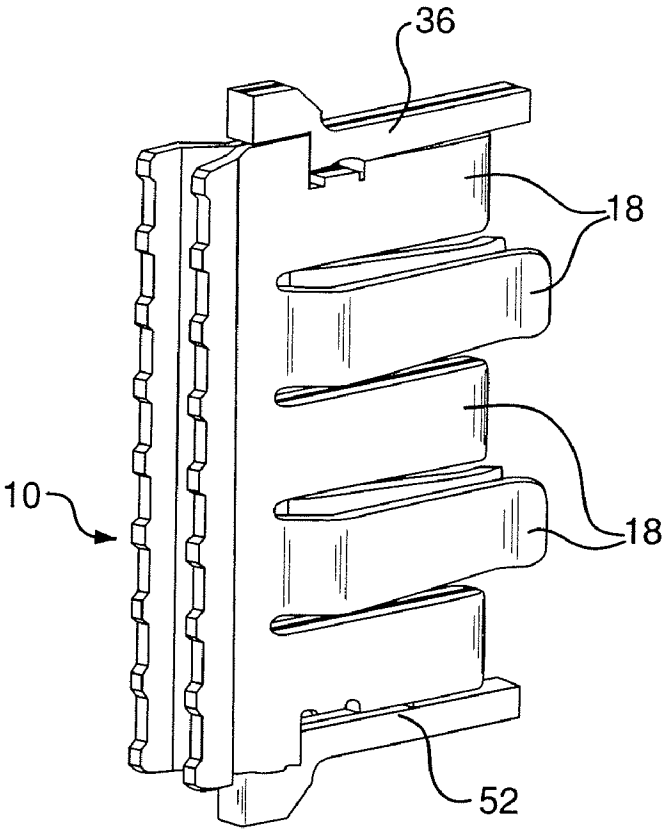
FIG. 1A (Prior Art)
FIG. 1A is a perspective view of a connector system depicting the relationship between a connector housing and a contact assembly found in the prior art.
Figure 1C:
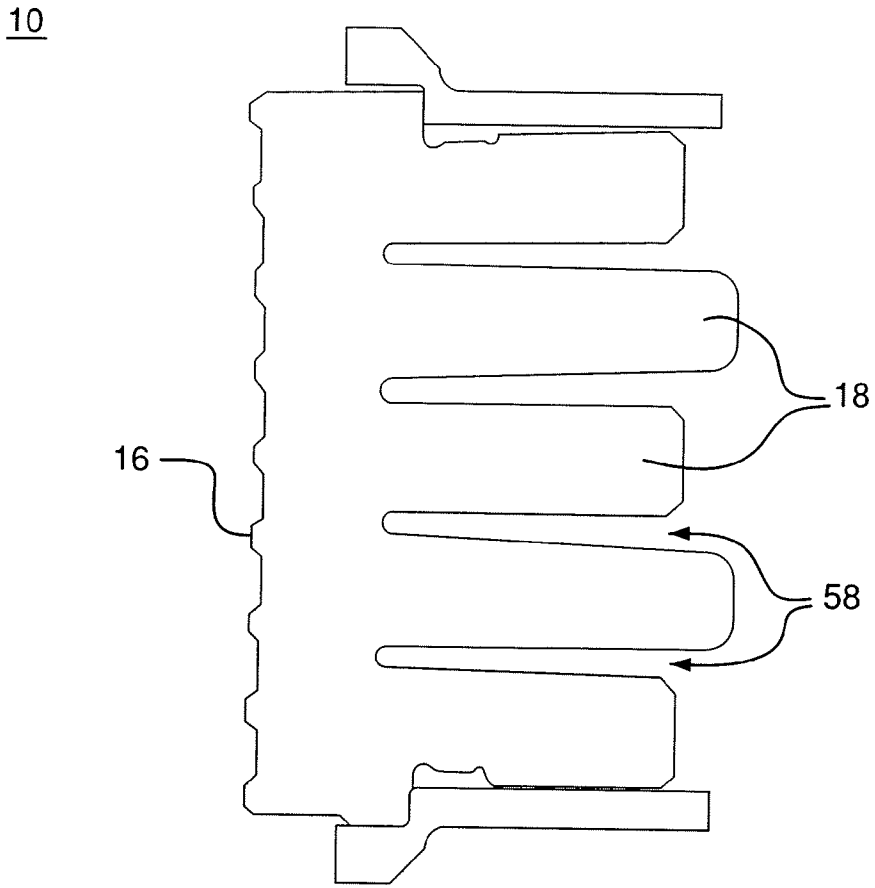
FIG.1C (Prior Art)
FIG. 1C is a side view of the connector system of FIG. 1A depicting a bowed contact.
Figure 2A:
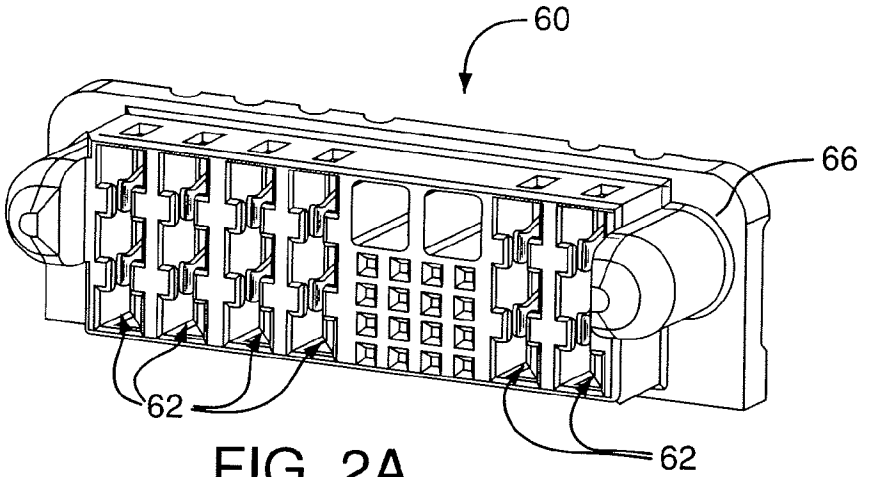
FIG. 2A is a front perspective view of an exemplary embodiment of a connector.
Figure 2B:
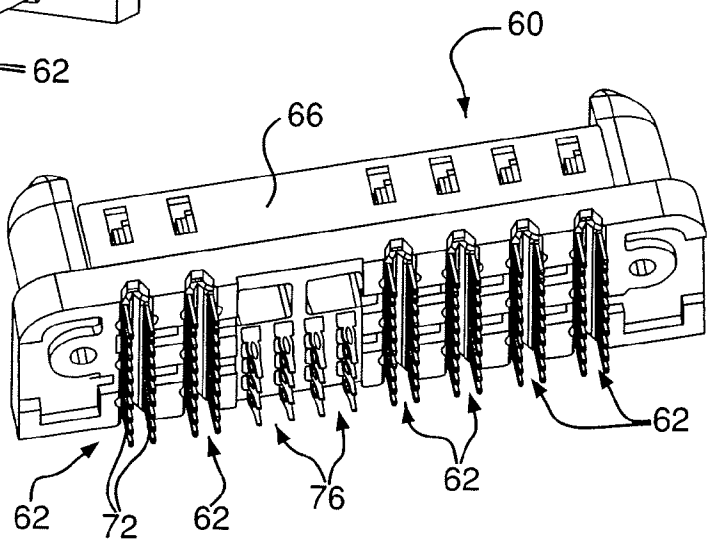
FIG. 2B is a back perspective view of the connector shown in FIG. 2A.

FIGS. 2A and 2B depict an example embodiment of a connector 60 having several contacts 62 mounted in a housing 66. As illustrated the contacts 62 may include several terminal pins 72. Additionally, the connector 60 may include an array of signal contacts 76 located between the contacts 62. When the terminal pins 72 are press fit onto a substrate, the connector 60 may inhibit bowing of the contacts 62. The particular configuration of connector 60 shown, is disclosed for exemplary purposes only. For example, while the connector 60 is depicted with six contacts 62, the connector 60 is not limited to such a number, and may include any number of contacts 60. Furthermore, while the particular connector 60 depicted is a vertical receptacle connector, the connector 60 is not limited to such an embodiment, and may include other configurations.

Figure 3:
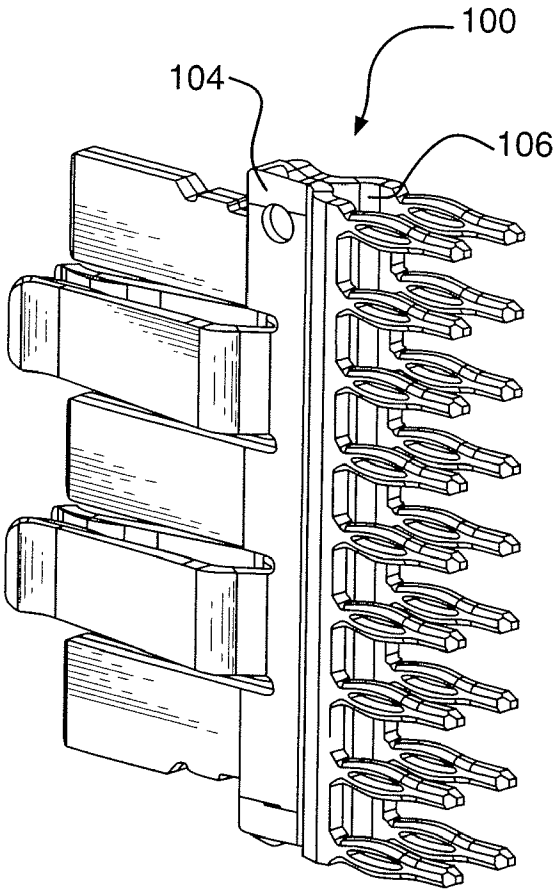
FIG. 3 is a perspective view of a contact.

FIG. 3 depicts an example embodiment of a contact 100 capable of being mounted in a connector housing. The contact 100 may be made from an electrically conductive material, such as metal. The contact 100 may be a power contact. As depicted, the contact 100 may include a first half 104 and a second half 106. While the contact 100 is depicted as comprising two halves, the contact 100 is not limited to such a design and may be manufactured as a single unitary structure.

Figure 4:
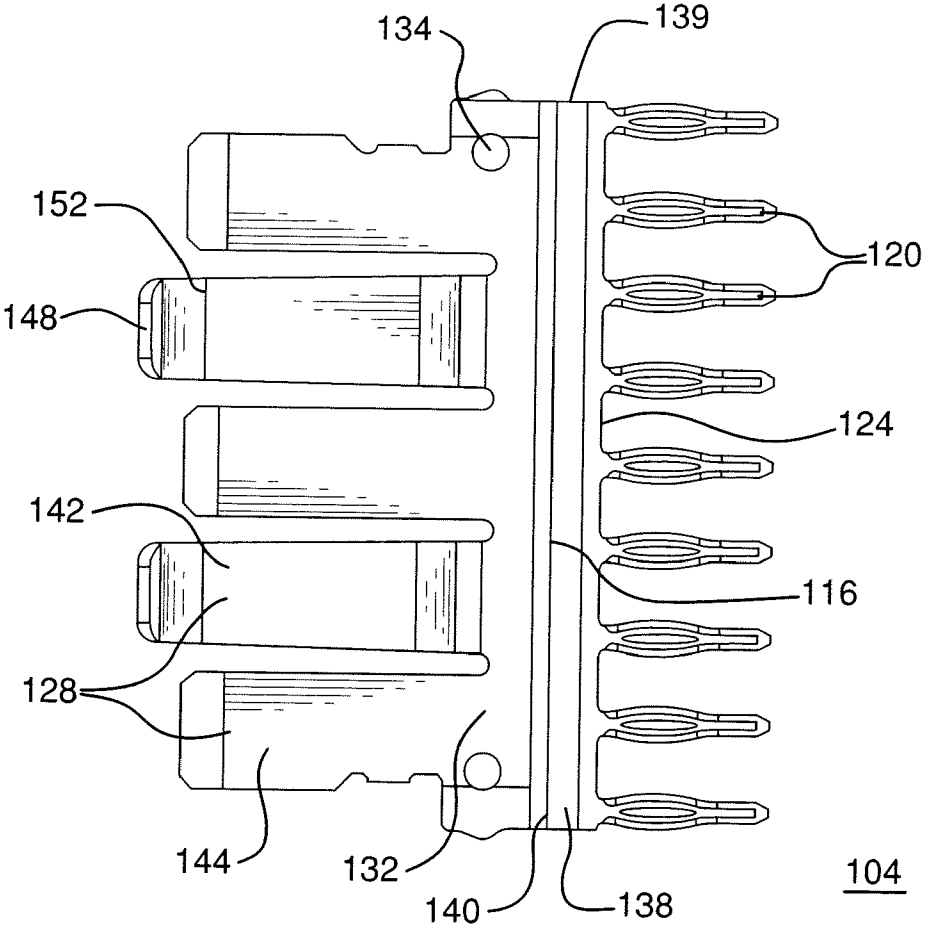
FIG. 4 is a side view of a first half of a contact.
Figure 5:
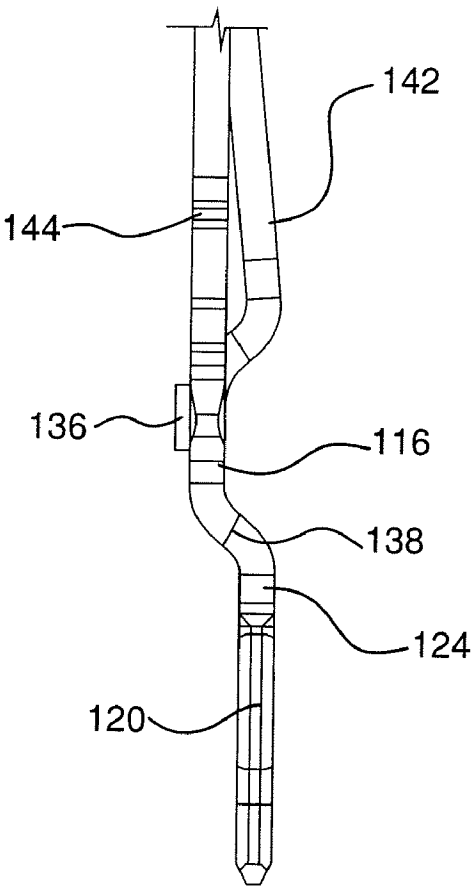
FIG. 5 is a partial bottom view of the first half of the contact of FIG. 4.

FIGS. 4 and 5 are more detailed views of the first half 104 of the contact 100. As depicted, the first half 104 may include a body 116, a plurality of terminal pins 120 extending from a first edge 124 of the body 116, and a plurality of contact beams 128 extending from a second edge 132 of the body 116.

As depicted, the body 116 may include a thru hole 134, a dimple 136 and a flared portion 138. The thru hole 134 may be formed in a first end 139 of the body 116, and the dimple 136 may protrude from a second end 140 of the body 116. The first end 139 may be opposite to the second end 140. The function of the thru hole 134 and the dimple 136 is explained below in connection with FIG. 6.

The terminal pins 120 may be capable of being received by penetrations in a substrate (not shown). The terminal pins 120 may be eye-of-the-needle press-fit pins. As best shown in FIG. 5, the terminal pins 120 of the first half 104 may be offset by the flared portion 138. As depicted, the flared portion 138 of the first half 104 may flare out in a first direction from the body 116.

The contact beams 128 may each be designed to have a specific structure. For example, the first half 104 may include two angled contact beams 142 and three substantially straight contact beams 144. The angled contact beams 142 and the straight contact beams 144 may be arranged in a staggered or alternating manner, i.e. each angled contact beam 142 may be positioned adjacent to a straight contact beam 144. Furthermore, the angled contact beams 142 may include a flared portion 148 at a first end 152 of the contact beams 142. An example angle in which the angled beam 142 may be formed can be seen in FIG. 5. The first half 104 is not limited to five contact beams 128 as depicted, and may include any number of contact beams 128. Furthermore, the first half 104 is not limited to alternating angled beams 142 and straight beams 144. For example, the first half 104 may have all angled beams 142 or all straight beams 144.

Figure 6:
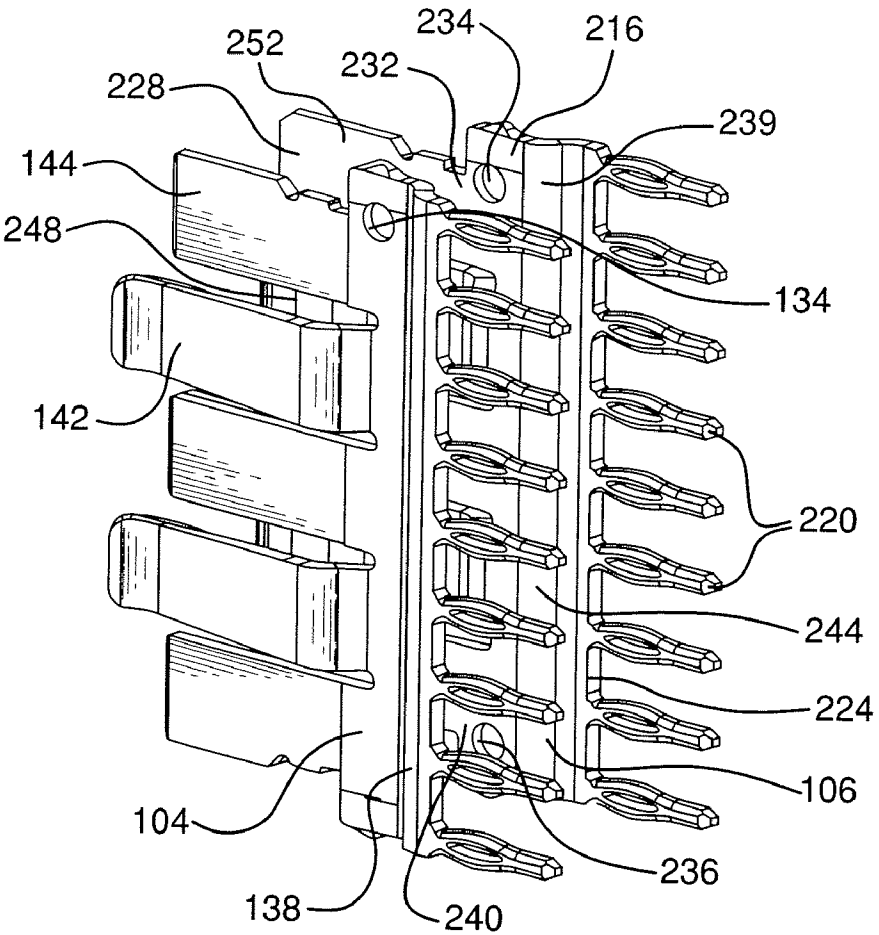
FIG. 6 is a perspective view of the first half of the contact of FIG. 4 positioned to combine with a second half of a contact.

FIG. 6 depicts the first half 104 and the second half 106 positioned to combine and form the contact 100. As depicted, the second half 106 may be identical to the first half 104 but may be rotated 180 degrees. Accordingly, like the first half 104, the second half 106 may have a body 216, a plurality of terminal pins 220 extending from a first edge 224 of the body 216, and a plurality of contact beams 228 extending from a second edge 232 of the body 216. In combination, the thru hole 134 of the first half 104 may receive a dimple 234 protruding from a first end 239 of the body 216 of the second half 106, and the dimple (not shown in FIG. 6) of the first half 104 may engage a thru hole 236 formed in a second end 240 of the body 216 of the second half 106.

The body 216 of the second half 106 may also include a flared portion 244. As depicted, the flared portion 244 may flare out from the body 216 of the second half 106. The flared portion 244 may flare out from the body 216 in a direction opposite of the flared portion 138 formed in the first half 104. That is, flared portion 244 may extend in one direction, while flared portion 138 may extend in the opposite direction.

The contact beams 228 of the second half 106 may also include angled contact beams 248 and straight contact beams 252. When the first half 104 is combined with the second half 106, the angled beams 142 of the first half 104 may align with the angled beams 248 of the second half 106. Similarly, the straight beams 144 of the first half 104 may align with the straight beams 252 of the second half 106. When the first half 104 and the second half 106 are combined, the combination may form a plurality of contact beam pairs 260 as depicted in FIG. 7.

Figure 7:
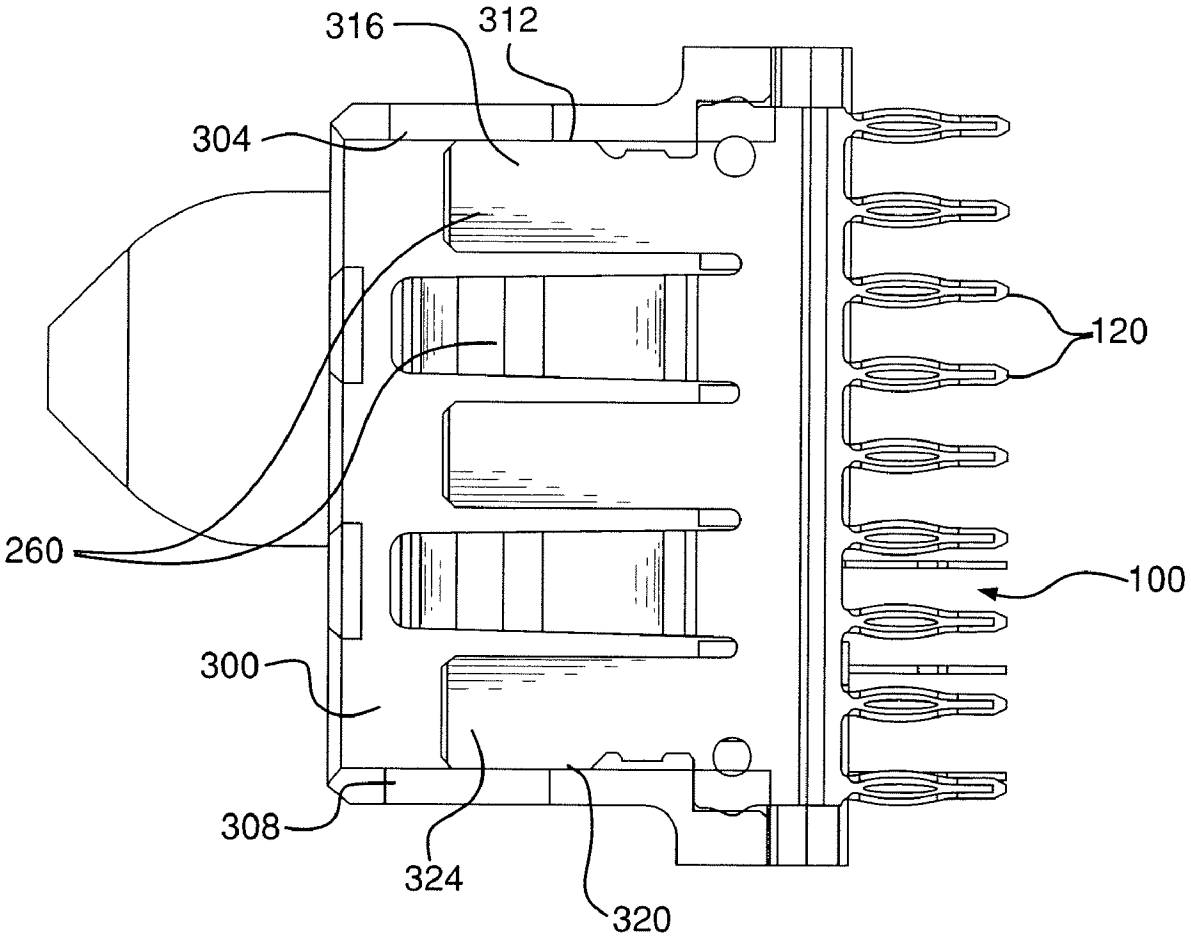
FIG. 7 is a cut away view of an example embodiment of a connector depicting the relationship between a housing and the contact of FIG. 3.

FIG. 7 depicts contact 100 mounted in a housing 300. The housing 300 may be made from a dielectric material such as a plastic for example. As depicted, the housing 300 may have a first sidewall 304 and a second sidewall 308. When the contact 100 is mounted in the housing 300, an edge 312 of a first contact beam 316 of the plurality of contact beam pairs 260 may be positioned proximate the first sidewall 304. Additionally, when the contact 100 is mounted in the housing 300, an edge 320 of a second contact beam 324 of the plurality of contact beam pairs 260 may be positioned proximate the second sidewall 308. As depicted, the edge 312 of the first contact beam 316, and the edge 320 of the second contact beam 324 may abut the first and second sidewalls 304, 308 of the housing 300. Alternatively, the edge 312 of the first contact beam 316, and the edge 320 of the second contact beam 324 may define a gap (not shown) with the respective first and second sidewalls 304, 308. The gap defined between the edge 312 of the first contact beam 316 and the first sidewall 304 and the gap defined between the edge 320 of the second contact beam 324 and the second sidewall 308 may be up to about 2 thousandths of an inch wide. Increasing the gap may increase the probability of bowing. Accordingly, there is preferably no gap.

The terminal pins 120, 220 of the contact 100 may be pressed into a substrate (not shown). During insertion of the terminal pins 120, 220 into the substrate the relationship (i.e. close proximity of) between the edge 312 of the first contact beam 316 and the first sidewall 304, and the relationship (i.e. close proximity of) between the edge 320 of the second contact beam 324 and the second sidewall 308 may help inhibit bowing or arcing of the contact 100. For example, the relationship may limit the deflection of the contact beam pairs 260 in directions substantially perpendicular to the direction in which the contact beam pairs 260 extend. Inhibiting the bowing of the contact 100 may not only limit the deflection of the contact beam pairs 260 but may also create a substantially uniform distribution of stress during press-fit of the terminal pins 120, 220 onto the substrate.

Figure 8:
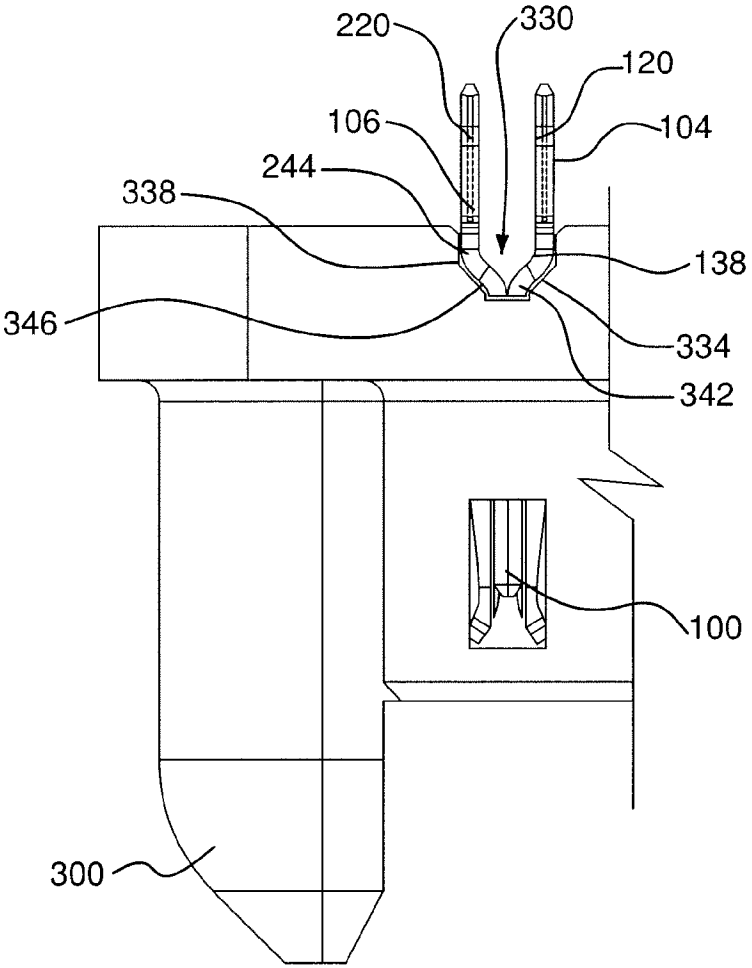
FIG. 8 is a partial top view of the connector of claim 7 depicting the relationship between the flared portions of the contact of FIG. 3 and the housing.

FIG. 8 depicts the relationship between the flared portions 138, 244 and the housing 300. As depicted the housing 300 may include an aperture 330 having a first side wall 334 and a second sidewall 338. When the contact 100 is mounted in the housing 300, an edge 342 of the flared portion 138 of the first half 104 may be positioned proximate the first sidewall 334 of the aperture 330. Additionally, when the contact 100 is mounted in the housing 300, an edge 346 of the flared portion 244 of the second half 106 may be positioned proximate the second sidewall 338 of the aperture 330. As depicted, the edge 342 of the flared portion 138, and the edge 346 of the flared portion 244 may abut the first and second sidewalls 334, 338 of the aperture 330. Alternatively, the edge 342 of the flared portion 138, and the edge 346 of the flared portion 244 may define a gap (not shown) with the respective first and second sidewalls 334, 338 of the aperture 330. The gap defined between the edge 342 of the flared portion 138 and the first sidewall 334 and the gap defined between the edge 346 of the flared portion 244 and the second sidewall 338 may be up to about 2 thousandths of an inch wide. Increasing the gap may increase the probability of bowing. Accordingly, there is preferably no gap.

During insertion of the terminal pins 120, 220 into the substrate, the relationship (i.e. close proximity of) between the edge 342 of the flared portion 138 and the first sidewall 334, and the relationship (i.e. close proximity of) between the edge 346 of the flared portion 244 and the second sidewall 338 may further help inhibit bowing or arcing of the contact 100. Inhibiting the bowing of the contact 100, as noted above, may limit the deflection of the contact beam pairs 260 and may create a substantially uniform distribution of stress during press-fit of the terminal pins 120, 220 onto the substrate.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

What is claimed:

1. An electrical connector capable of being mounted on a substrate, the electrical connector comprising:

a housing defining a housing surface; and a contact mounted in the housing, the contact comprising a body, a plurality of terminal pins extending from a first edge of the body and capable of being received by penetrations in the substrate, and a plurality of contact beams extending from a second edge of the body, wherein at least a portion of one of the contact beams is spaced from the housing surface by a gap of no more than 0.002 inch when the electrical connector is not mounted on the substrate such that engagement between the at least a portion of one of the contact beams and the housing surface limits bowing of the contact as the terminal pins are press-fit mounted into the substrate.

2. The electrical connector of claim 1, wherein the body includes a flared portion that is spaced from an adjacent surface of the housing by a gap of no more than 0.002 inch when the electrical connector is not mounted on the substrate.

3. The electrical connector of claim 1, wherein the housing defines a vertical receptacle housing.

4. The electrical connector of claim 1, wherein the engagement between the at least a portion of one of the contact beams and the housing creates a substantially uniform distribution of stress along the terminal pins as the terminal pins are press-fit mounted into the substrate.

5. The electrical connector of claim 1, wherein the contact comprises a first half and a second half separable from the first half.

6. The electrical connector of claim 1, wherein the housing surface is a first housing surface, and the housing further comprises a second housing surface, and the one of the contact beams is a first contact beam, and contact the further comprises a second contact beam, and at least a portion of the second contact beam is spaced from the second housing surface by a gap of no more than 0.002 inch before the terminal pins are press-fit mounted into the substrate.

7. The electrical connector of claim 6, wherein the contact beams are arranged in a substantially linear array and the first and second contact beams are located at respective first and second outer ends of the substantially linear array.

8. The electrical connector of claim 6, wherein the at least a portion of the first and second contact beams abut the respective first and second housing surfaces when the electrical connector is not mounted on the substrate.

9. The electrical connector of claim 6, wherein the contact beams extend substantially from the body in a first direction, and contact between the contact beams and the respective first and second housing surfaces limits deflection of the contact beams in directions substantially perpendicular to the first direction as the terminal pins are inserted into the penetrations in the substrate.

10. The electrical connector as recited in claim 6, wherein engagement between the at least a portion of the second contact beam and the second housing surface further limits bowing of the contact as the terminal pins are press-fit into the substrate.

11. An electrical connector capable of being mounted on a substrate, the electrical connector comprising:

a housing defining a housing surface; and a contact mounted in the housing, the contact comprising a body, a plurality of terminal pins extending from a first edge of the body and capable of being received by penetrations in the substrate, and a plurality of contact beams extending from a second edge of the body, wherein the body includes a flared portion, the flared portion being spaced from the housing surface by a gap of no more than 0.002 inch when the electrical connector is not mounted on the substrate such that the flared portion engages the housing surface to limit bowing of the contact as the terminal pins are press-fit mounted into the substrate.

12. The electrical connector of claim 11, wherein the housing defines a vertical receptacle housing.

13. The electrical connector of claim 11, wherein the flared portion abuts the respective adjacent surface of the housing when the electrical connector is not mounted on the substrate.

14. The electrical connector of claim 11, wherein the contact comprises a first half and a second half separable from the first half.

15. A method of restricting bowing in an electrical connector configured for connection to a substrate, the method comprising the steps of:

providing a housing defining opposing first and housing surfaces; and disposing a contact in the housing, wherein the contact includes a contact body having opposing first and second edges, a plurality of terminal pins extending from the first edge, and a plurality of contact beams extending from the second edge, such that first and second contact beams of the plurality of contact beams are spaced from the first and second housing surfaces, respectively, by a gap of no more than 0.002 inch;

press-fitting the terminal pins into the substrate so as to mount the electrical connector onto the substrate; and during the press-fitting step, causing the first and second contact beams to engage the first and second housing surfaces so as to limit bowing of the contact.

16. The method as recited in claim 15, wherein the body includes a flared portion and the housing defines a third housing surface, and the positioning step further comprises spacing the flared portion from the third housing surface by a gap of no more than 0.002 inch.

17. The method as recited in claim 15, wherein the first and second contact beams abut the respective first and second housing surfaces.

18. An electrical connector capable of being mounted on a substrate, the electrical connector comprising:

a housing defining a housing surface; and a contact mounted in the housing, the contact comprising a body, a plurality of terminal pins extending from a first edge of the body and capable of being received by penetrations in the substrate, and a plurality of contact beams extending from a second edge of the body, wherein at least one of the contact beams engages the housing surface as the terminal pins are press-fit into the substrate so as to cause each of the terminal pins to receive a substantially equal force as the terminal pins are press-fit mounted into the substrate.

19. The electrical connector as recited in claim 18, wherein each body includes a flared portion that is spaced from an adjacent housing surface by a gap of no more than 0.002 inch when the electrical connector is not mounted on the substrate.

20. The electrical connector as recited in claim 19, wherein the flared portion abuts the adjacent housing surface when the electrical connector is not mounted on the substrate.

21. The electrical connector as recited in claim 18, wherein an outer pair of contact beams of the plurality of contact beams each is spaced from respective adjacent housing surfaces by a gap of no more than 0.002 inch when the electrical connector is not mounted on the substrate.

22. The electrical connector as recited in claim 21, wherein the outer pair of contact beams of the plurality of contact beams each abuts the respective adjacent housing surfaces when the electrical connector is not mounted on the substrate.

23. An electrical connector capable of being mounted on a substrate, the electrical connector comprising:

a housing defining a housing surface; and a contact mounted in the housing, the contact comprising a body, a plurality of terminal pins extending from a first edge of the body and capable of being received by penetrations in the substrate, and a plurality of contact beams extending from a second edge of the body, wherein engagement between one of the contact beams and the housing causes the terminal pins to extend into the penetrations in the substrate at a substantially constant depth when the terminal pins are press-fit mounted into the substrate.

24. The electrical connector as recited in claim 23, wherein each body includes a flared portion that is spaced from an adjacent housing surface by a gap of no more than 0.002 inch when the electrical connector is not mounted on the substrate.

25. The electrical connector as recited in claim 24, wherein the flared portion abuts the adjacent housing surface when the electrical connector is not mounted on the substrate.

26. The electrical connector as recited in claim 23, wherein an outer pair of contact beams of the plurality of contact beams each is spaced from respective adjacent housing surfaces by a gap of no more than 0.002 inch when the electrical connector is not mounted on the substrate.

27. The electrical connector as recited in claim 26, wherein the outer pair of contact beams of the plurality of contact beams each abuts the respective adjacent housing surfaces when the electrical connector is not mounted on the substrate.

* * * * *